US009322618B1

(12) United States Patent
Tuttle et al.

(10) Patent No.: US 9,322,618 B1
(45) Date of Patent: Apr. 26, 2016

(54) BLAST DEBRIS PROTECTIVE HARNESS

(71) Applicant: The United States of America as represented by the Secretary of the Army, Washington, DC (US)

(72) Inventors: Cara Tuttle, West Roxbury, MA (US); Magdalena Mulherin, Marlborough, MA (US); Annette LaFleur, Natick, MA (US); Kristine Isherwood, Boston, MA (US); Katherine Mitchell, Natick, MA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 594 days.

(21) Appl. No.: 13/685,747

(22) Filed: Nov. 27, 2012

(51) Int. Cl.
*F41H 1/02* (2006.01)

(52) U.S. Cl.
CPC ..... *F41H 1/02* (2013.01)

(58) Field of Classification Search
CPC ..... A41H 1/02; F41H 1/02; A41D 13/05
USPC ..... 2/2.5
See application file for complete search history.

(56) References Cited

U.S. PATENT DOCUMENTS

| | | | | | |
|---|---|---|---|---|---|
| 1,720,439 | A | * | 7/1929 | Richardson | 2/466 |
| 2,790,973 | A | * | 5/1957 | Lewis, Jr. et al. | 2/2.5 |
| 3,550,590 | A | * | 12/1970 | Keilman | 602/73 |
| H7 | H | * | 1/1986 | Martone | 2/2.5 |
| 4,922,899 | A | * | 5/1990 | Graff et al. | 602/72 |
| 5,060,314 | A | * | 10/1991 | Lewis | 2/2.5 |
| 5,295,267 | A | * | 3/1994 | Galindo | 2/466 |
| 5,398,340 | A | * | 3/1995 | Kibbee | 2/2.5 |
| 5,465,424 | A | * | 11/1995 | Cudney et al. | 2/462 |
| 5,471,906 | A | * | 12/1995 | Bachner et al. | 2/2.5 |
| 5,754,982 | A | * | 5/1998 | Gainer | 2/2.5 |
| 5,966,747 | A | * | 10/1999 | Crupi et al. | 2/466 |
| 6,266,818 | B1 | * | 7/2001 | Howland et al. | 2/2.5 |
| 6,345,396 | B1 | * | 2/2002 | Schuler | 2/467 |
| 6,453,791 | B1 | * | 9/2002 | Seitzinger | 2/2.5 |
| 6,684,404 | B2 | * | 2/2004 | Bachner et al. | 2/2.5 |
| 6,698,024 | B2 | * | 3/2004 | Graves et al. | 2/2.5 |
| 7,178,176 | B1 | * | 2/2007 | S-Cronenbold | 2/466 |
| 7,266,850 | B1 | * | 9/2007 | Strum et al. | 2/2.5 |
| 7,386,894 | B2 | | 6/2008 | Straiton | |
| 7,810,167 | B2 | * | 10/2010 | Seitzinger et al. | 2/2.5 |
| 8,146,169 | B2 | * | 4/2012 | Marchesi | 2/2.5 |
| 8,347,422 | B2 | * | 1/2013 | Kalaam et al. | 2/463 |
| 8,561,213 | B2 | * | 10/2013 | Howell et al. | 2/2.5 |
| 8,646,116 | B2 | * | 2/2014 | Crye et al. | 2/466 |
| 2002/0073473 | A1 | * | 6/2002 | Bachner et al. | 2/2.5 |
| 2005/0177931 | A1 | * | 8/2005 | Tsujimoto | 2/466 |
| 2007/0016996 | A1 | * | 1/2007 | Seitzinger et al. | 2/2.5 |
| 2008/0134419 | A1 | * | 6/2008 | Kalaam et al. | 2/463 |
| 2010/0229273 | A1 | * | 9/2010 | Crye | 2/2.5 |
| 2010/0269234 | A1 | | 10/2010 | Bennett | |
| 2010/0275349 | A1 | * | 11/2010 | Wilson, II | 2/466 |
| 2011/0072545 | A1 | * | 3/2011 | Bennett | 2/2.5 |

FOREIGN PATENT DOCUMENTS

WO WO 2012135578 A1 * 10/2012

* cited by examiner

*Primary Examiner* — Richale Quinn
(74) *Attorney, Agent, or Firm* — Roger C. Phillips

(57) ABSTRACT

A blast debris protective harness includes a front shell portion and a rear shell portion joined together. Each of the front and rear shell portions has an inside shell member and an outside shell member. A cavity is defined between the inside shell member and the outside shell member. A ballistic insert is configured to be retained within the cavity. The harness is an outer garment.

8 Claims, 8 Drawing Sheets

BLAST DEBRIS PROTECTIVE HARNESS

STATEMENT OF GOVERNMENT INTEREST

The invention described herein may be manufactured and used by or for the U.S. Government for governmental purposes without the payment of any royalties thereon or therefor.

FIELD

The aspects of the present disclosure relate generally to the field of body armor, and in particular to blast debris protection.

BACKGROUND

There are many types of body armor for protecting the upper body or torso of an individual, such as soldiers or warfighters, in combat zones. However, the lower torso is also vulnerable to injury from blast related events. The lower torso is generally intended to include areas of the body such as the lower intestines, colon, groin, bladder, femoral arteries, and lower portions of the back, spine, and kidneys. Until recently, approaches for protecting the lower torso of a soldier have generally been limited to frontal protection of the groin and upper leg regions. However, this generally left other approach angles in the urogenital area and other areas of the lower torso such as the femoral artery and perineum exposed during a blast event.

One approach to protecting the lower torso was a groin panel. The groin panel was a flat panel that hung from the body armor vest. However, the groin panel would have a tendency to flap and hit the wearer in the very area it was intended to protect, causing discomfort. Also, whenever the soldier would take a knee, the panel would be lifted by the thigh, exposing the urogenital, perineal and femoral regions. Additionally, a blast event could result in movement of the panel away from the area it is intended to protect.

A next generation groin panel had a three-dimensional contour and attachment to the trousers to improve the panel's lay against the body, even when taking a knee. The shaped groin panel was coupled with a blast protective diaper. However, the shaped groin panel and protective diaper system lacked femoral, pelvic and thigh coverage. The system would also need to be worn very snugly against the body to ensure protection given its limited area of coverage and was cumbersome to wear.

Other efforts have been made in the form of over garment body armor having over garment shorts. These shorts are meant to be pulled over clothing. However, such garments do not provide protective coverage of the urogenital and perineal regions of the lower torso. These types of garments also do not provide for ease of evacuation or medical access. The designs and fabrication of these types of garments also tend to be split, with breaks in the areas of coverage.

Thus, while efforts have been made to provide protection of the lower torso from hazards such as blast related events, these efforts have generally lacked adequate protective coverage, lacked user acceptance, and did not interface well with either the user or other body worn equipment.

Accordingly, it would be desirable to provide a protective garment for the lower torso that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a blast debris protective harness. In one embodiment, the blast debris protective harness includes a front shell portion and a rear shell portion. Each of the front and rear shell portions has an inside shell member and an outside shell member. A cavity is defined between the inside shell member and the outside shell member. The ballistic material insert can be configured to be retained or removably retained within the cavity. The harness is an outer garment.

Another aspect of the exemplary embodiments relates to a blast protective outer garment for a lower torso of a wearer. In one embodiment, the blast protective outer garment includes a single piece hollow shell comprising a front portion and a back portion. A single piece ballistic insert is configured to be received in the hollow shell and extends from the front portion into and through the back portion. A waist member is coupled to an end of each of the front and back portion and configured to join the front and back portions around a waist of the wearer. An opening is defined between the waist member and each of the front and back portions to enable access to a pocket of an undergarment of the wearer. The garment provides blast protection to urogenital, perineum and femoral artery regions of the lower torso of the wearer.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 2:
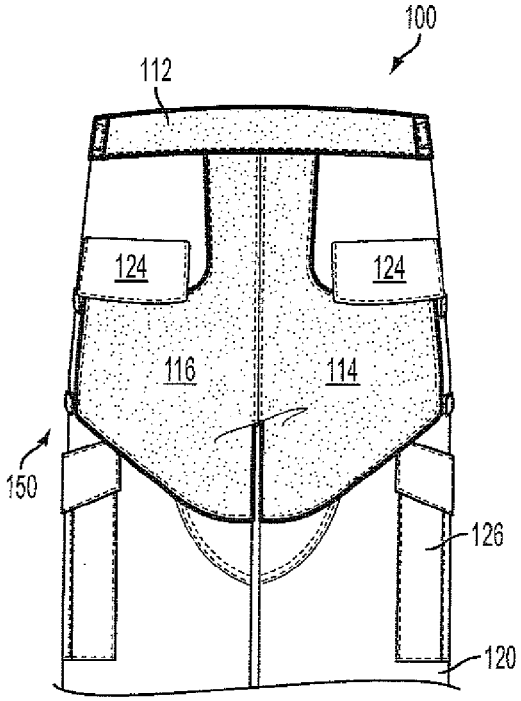
FIG. 2 illustrates a rear view of one embodiment of a protective harness incorporating aspects of the present disclosure.

Referring to FIG. 2, one embodiment of a protective harness incorporating aspects of the present disclosure is generally designated by reference numeral 100. The aspects of the disclosed embodiments are directed to a uniquely shaped protective harness in the form of an over garment that offers protective coverage of areas of human body that generally include the regions of the lower torso and upper leg, such as the urogenital, perineal and femoral artery regions, from blast and other combat related events. The term lower torso, as is used herein, is generally intended to include the regions of the upper leg as well. The harness is adjustable to accommodate different size wearers, is fitted closely to the body and yet provides freedom in the range of movement, and provides complete coverage of the groin area with no breaks. Although the aspects of the disclosed embodiments are generally described herein with respect to blast related events, the aspects of the disclosed embodiments are not so limited. In one embodiment, the protective harness can also provide protection from events such as small arms fire. The protective harness 100 can also be referred to as protective shorts.

Figure 1:
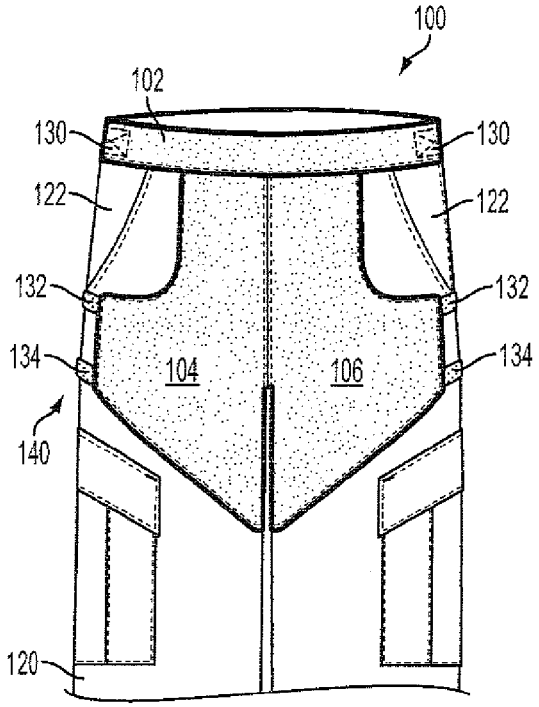
FIG. 1 illustrates a front view of one embodiment of a protective harness incorporating aspects of the present disclosure.
Figure 7:
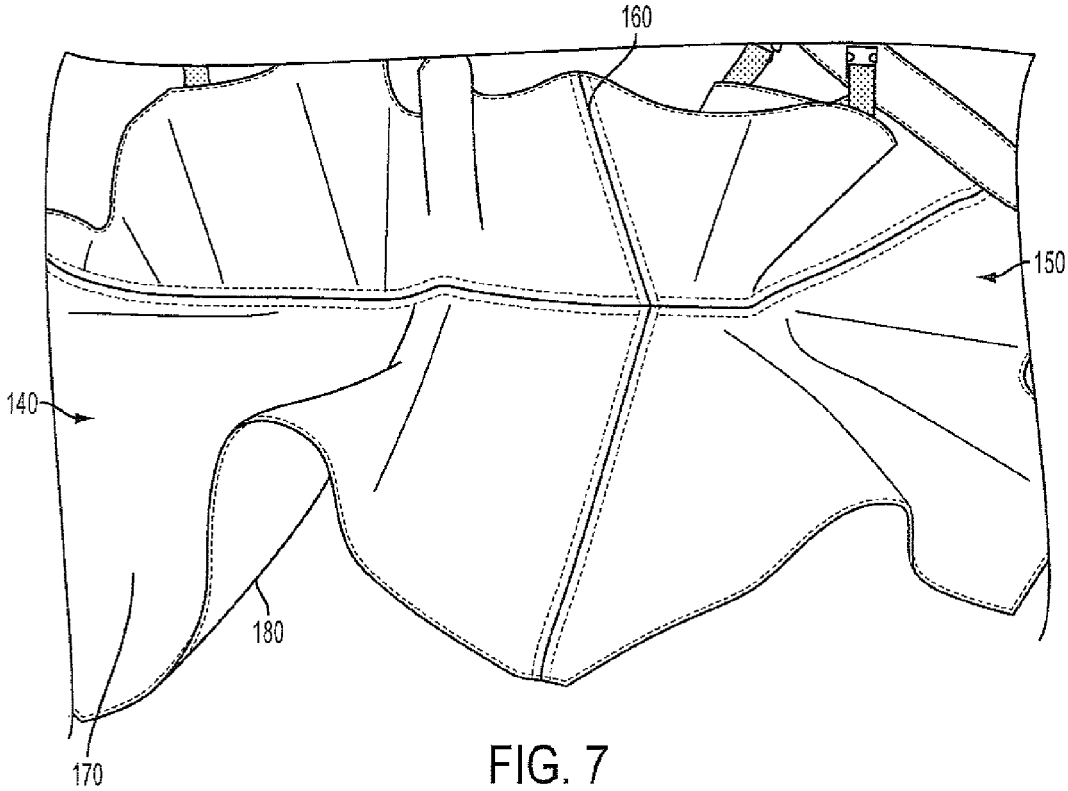
FIG. 7 illustrates a center portion of one embodiment of a protective harness incorporating aspects of the present disclosure.

FIG. 1 illustrates a front view of one embodiment of a protective garment or harness 100 incorporating aspects of the present disclosure. The protective harness 100 is a one piece harness, generally comprising a front shell portion 140, shown in FIG. 1, and a rear or back shell portion 150, shown in FIG. 2. The front shell portion 140 and back shell portion 150 are joined together at what will be referred to herein as the crotch or groin area. The protective harness 100 offers blast protective coverage of lower torso and upper leg regions of the body, including the urogenital, perineal, spinal and femoral artery regions of the body. There are no breaks in the areas of coverage provided by the protective harness 100. FIG. 7 illustrates the joining 160 of the front and back portions 140 and 150 to form the single or one piece garment. The joining 160 of the front and back portions 140, 150 generally encompasses an area of the lower torso between the wearer's legs, also referred to herein as the crotch or groin area. Although the harness 100 is described herein as having a front and rear portion, these designations are for illustration purposes only. In one embodiment, the material of the protective harness 100 is generally a nylon cordura or nylon ripstop material. In alternate embodiments, any suitable material can be used.

As shown in FIG. 1, the front shell portion 140 generally includes a front waist member 102, and right and left front panels 104, 106, respectively. The right and left panels 104, 106 are substantially symmetrical. FIG. 2 illustrates the back view of the protective harness 100 shown in FIG. 1. In this embodiment, the protective harness 100 includes a back or rear waist member 112, and right and left rear panels 114, 116, respectively.

As is illustrated in FIGS. 1 and 2, the protective harness 100 is in the form of an outer garment that is configured to go over a pant or trouser member 120. In this example, the pant member 120, which could also include a pair of shorts or other suitable lower torso garment includes front pocket members 122, shown in FIG. 1, and rear pocket members 124, shown in FIG. 2, as well as lower or side pocket members 126. For purposes of the description herein, the right and left pockets of the pant member 120 will not be separately referred to. The aspects of the disclosed embodiments provide wearer access to each of the pocket members 122, 124 and 126 when the protective harness 100 is worn or fastened over the pants 120.

Figure 3:
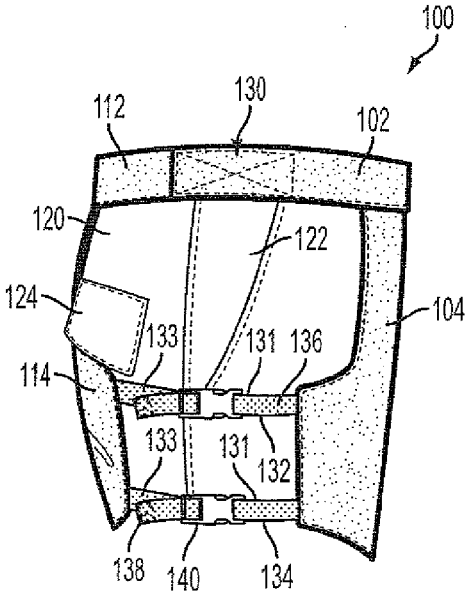
FIG. 3 illustrates a side view of one embodiment of a protective harness incorporating aspects of the present disclosure.

FIG. 3 illustrates a right side view of the protective harness 100 of FIG. 1. As is shown in FIG. 3, the upper or waist side closure member or coupling device 130 joins the front and back waist members 102, 112 on each side, while lower or hip closure members 132, 134 couple the front panels 104, 106 to the respective rear panels 114, 116. The terms "waist" and "hip" are used herein to generally describe a region of the torso, without limiting the scope of the disclosed embodiments. Although not shown in FIG. 3, the left side of the protective harness 100 also includes an upper closure member 130 and lower closure members 132, 134. The closure members 130, 132, 134 are generally configured to allow the wearer to quickly open the closure members at one side for ease of evacuation or removal of the protective harness 100. In one embodiment, the upper closure member 130 is a hook and loop closure member, while lower closure members 132, 134 comprise buckle type closure member. In alternate embodiments, any suitable closure members can be used. The closure members 130, 132 and 134 of the disclosed embodiments are generally configured to be releasable to provide ease of donning, doffing and evacuation, as well as to be adjustable for providing adjustability for a range of sizes.

In one embodiment, the lower closure members 132, 134 can comprise an elastic material 136 that is configured to provide an ease of movement to the user when the protective harness 100 is being worn as well as a webbing material 138 that provides durability. In one embodiment, the buckle closure members 132, 134 include a plastic buckle member 140 to join the front and back portions 131, 133 of the buckle closure member 132, 134. Although a buckle closure member is described herein, the aspects of the disclosed embodiment are not so limited and can include any suitable closure devices that allows ease of connecting, disconnecting and size adjustment, other than including a buckle. For example, in one embodiment, a snap or hook and fastener closure device that includes a size adjustment device can be used.

Figure 4:
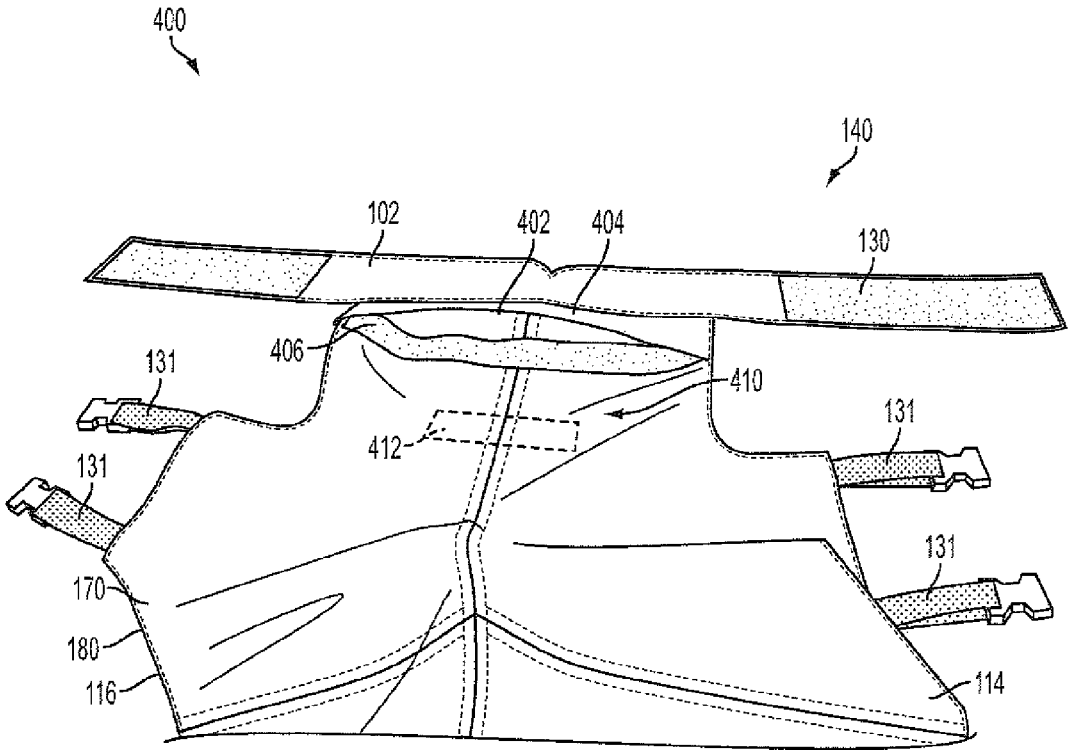
FIG. 4 illustrates a plan view of an interior the front portion of one embodiment of a protective harness incorporating aspects of the present disclosure.

FIG. 4 illustrates one embodiment of the inner side 400 of the front shell 140 of the protective harness 100. As will be described herein, the protective harness 100 is formed from two pieces of garment material, referred to as an inner member or piece 170 and an outer member or piece 180. The inner and outer members 170 and 180 can be stitched together to form the protective harness 100. A pouch area 410 shown in FIG. 4 is defined between the inner and outer members 170, 180. As will be described herein, in one embodiment, ballistics can be removably inserted into, and secured within, the pouch area 410.

As shown in FIG. 4, the inner portion 400 of the front shell 140 includes an opening 402 to the pouch area 410. The opening 402 is defined by a closure member 406, which in this embodiment comprises a releasable closure member, such as for example, a hook and loop fastener device. In the embodiment shown in FIG. 4, the opening 402 includes a flap member 404 and a shell member 406. The flap member 404 will removably couple to the shell member 406 to close the opening 402.

The pouch 410 generally runs from the front shell portion 140 through the rear shell portion 150. In one embodiment, the front shell 140 of the protective harness 100 includes a releasable fastener such as a hook and loop fastener member 412 on an inside of the pouch 410. In the embodiment shown in FIG. 4, the fastener member 412 is stitched to the inner member 170 of the protective harness 100. The fastener member 412 will be used to removably secure ballistics within the pouch area 410, as is described herein below. Although only one fastener member 412 is shown, in alternate embodiments, any suitable number of fastener members can be used.

Figure 5:
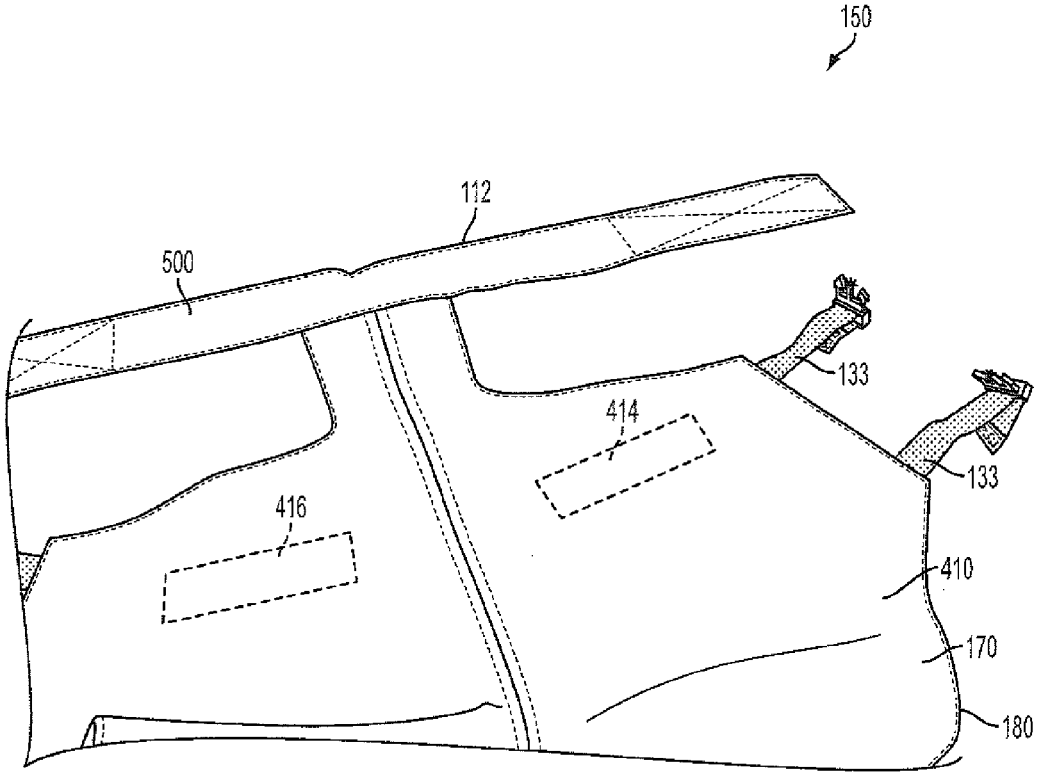
FIG. 5 illustrates a plan view of an interior of the back portion one embodiment of a protective harness incorporating aspects of the present disclosure.

FIG. 5 illustrates one embodiment of the inner portion 500 of the back shell portion 150 of the protective harness 100 shown in FIG. 1. The pouch area 410 extends into the back shell portion 150. In one embodiment, the pouch area 410 in the back shell portion 150 includes one or more hook and loop fastener members 414, 416, to secure the ballistics within the pouch area 410 of the back shell portion 150. Although two fastener members 414, 416 are shown in FIG. 5, in alternate embodiments, any suitable number of fastener members 414, 416 can be used, other than including two.

Figure 6:
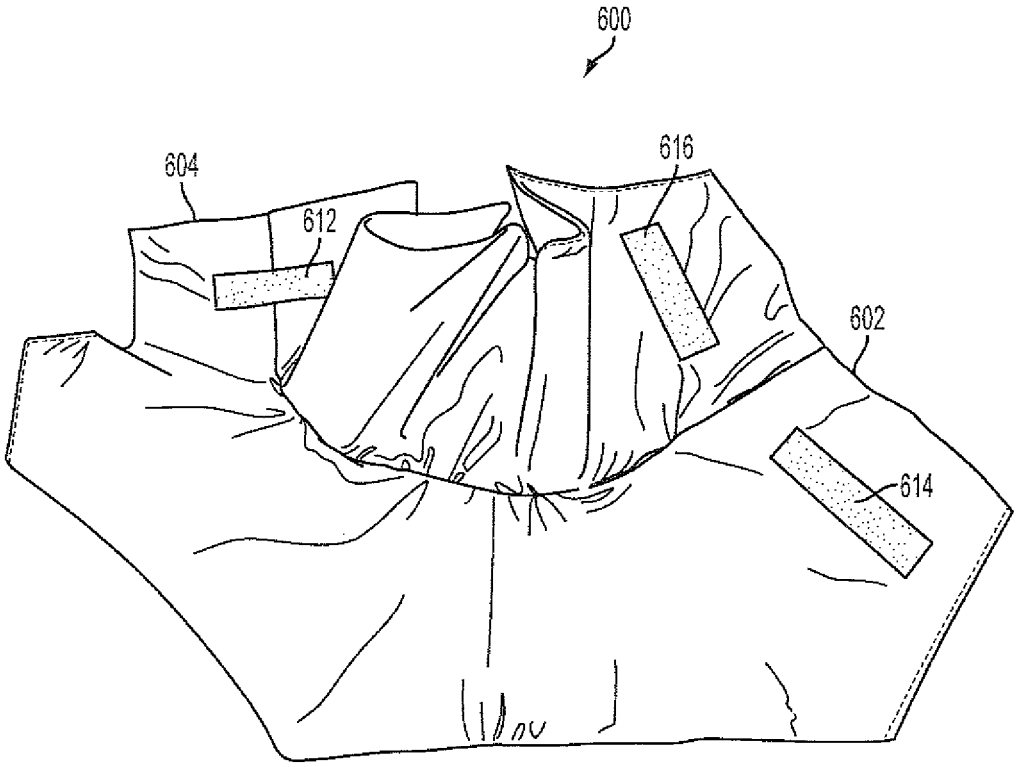
FIG. 6 illustrates a perspective view of one embodiment of a ballistic insert for use in one embodiment of a protective harness incorporating aspects of the present disclosure.

FIG. 6 illustrates one embodiment of a ballistics insert or casing 600 that can be used with the protective harness 100 of FIG. 1. The ballistics insert 600 will generally include suitable ballistic materials, such as for example KEVLAR™ encased within a nylon fabric casing or other such suitable fabric. Although KEVLAR™ is generally described herein as being used with the protective harness 100 of the present disclosure, in alternate embodiments, any suitable protective material can be used. The aspects of the disclosed embodiment are generally directed to the use of a lightweight, durable and flexible material that provides sufficient protection to the lower torso from blast and other combat related events. The ballistics insert 600 will generally comprise a single, continuous piece that, when retained within the pouch area 410, encompasses substantially all of the entire length and width of the shape of the protective harness 100. In one embodiment, the ballistics insert 600 is a continuous protective member without any gaps at the seams. As will be discussed with respect to FIG. 9, the protective harness 100 is constructed to not have typically butted seams that would allow for gaps or the entry of debris into the seam or joining area. Rather, as will be shown with respect to FIG. 9, the seams overlap on each side so there is effectively no gap or other break in coverage of the material at any joining areas, such as joining area 160 shown in FIG. 7. The overlapping nature of these joining areas provides that debris cannot penetrate or get through these joining areas or seams.

The ballistics insert 600 is generally held or retained within the pouch 410 of the protective harness 100 using hook and loop fastener members. In one embodiment, the ballistics insert 600 is removably retained within the pouch 410. In the embodiments illustrated in FIGS. 4 and 5, hook and loop fastener members 412, 414 and 416 are coupled to the front and rear shell portions 140, 150 of the protective harness. The ballistics insert 600 shown in FIG. 6 includes complementary hook and loop fastener members 612, 614 and 616. By mating respective pairs of hook and loop fastener members, 412-612; 414-614; and 416-616, the ballistics insert 600 can be removably secured and retained within the pouch area 410 of the protective harness 100. In one embodiment, the fastener members 612, 614 and 616 are stitched to the ballistics insert 600 by sewing through all of the layers of the insert 600 into the ballistics contained therein. Although only three fastener members 612, 614 and 616 are shown in FIG. 6, in alternate embodiments, any suitable number of fastening members can be used.

Referring again to FIG. 4, in one embodiment, the ballistics insert 600 is inserted into the front shell 140 through the opening 402. The back portion 602 of the ballistic insert 600 can be fed into the opening 402 first. The fasteners members 614 and 616 on the ballistics insert 600 are aligned with and attached to corresponding fastener members 414 and 416 on the back shell 150. The fastener member 612 is then aligned with and attached to the corresponding fastener member 412 on the front shell portion 140. The opening 402 can then be closed by sealing flap member 404 to shell member 406 to conceal the ballistics.

FIG. 7 illustrates the seam portion 160 joining the front and back portions 140, 150 of the protective harness 100. The seam portion 160 is situated at the intersection of the front shell portion 140 and rear shell portion 150. The seam portion 160 generally comprises the crotch area of the lower torso.

Figure 8:
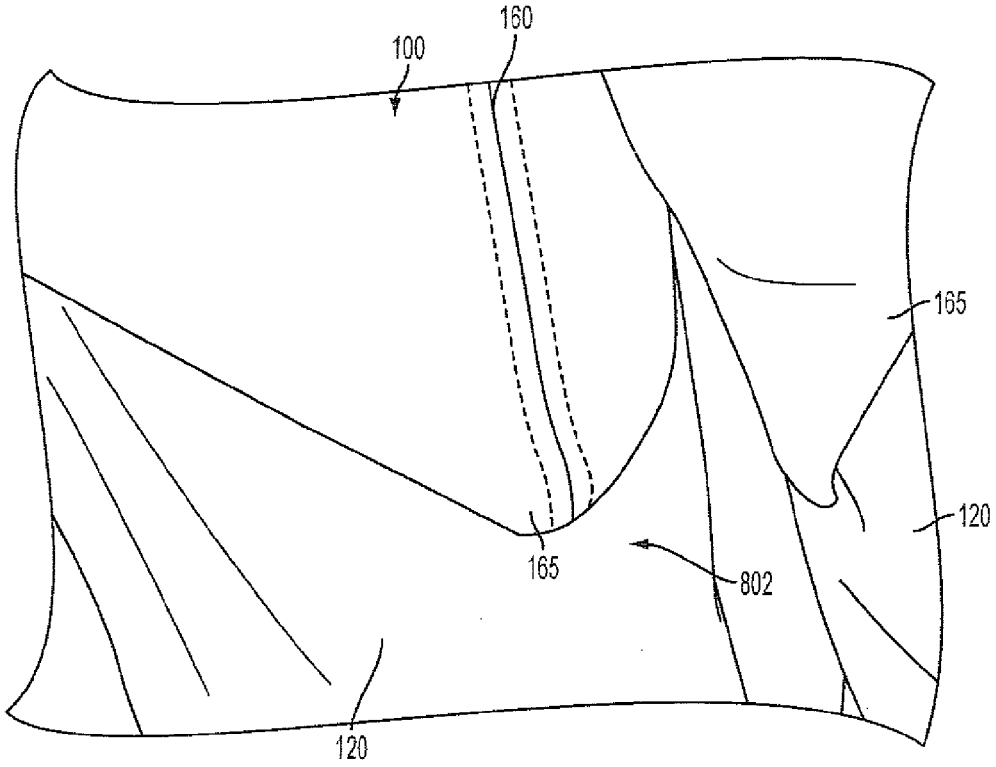
FIG. 8 illustrates the extension of the portion of the protective harness shown in FIG. 7 along the inner leg of the user.

FIG. 8 illustrates the extension 165 of the protective harness 100 along the inner thigh. In this example, the extension 165 provides extensive femoral artery coverage, extending from the crotch area of the user to a point 802 that generally corresponds to a mid-thigh area of the user, such as for example, eight inches of coverage for a medium-sized male user.

Figure 9:
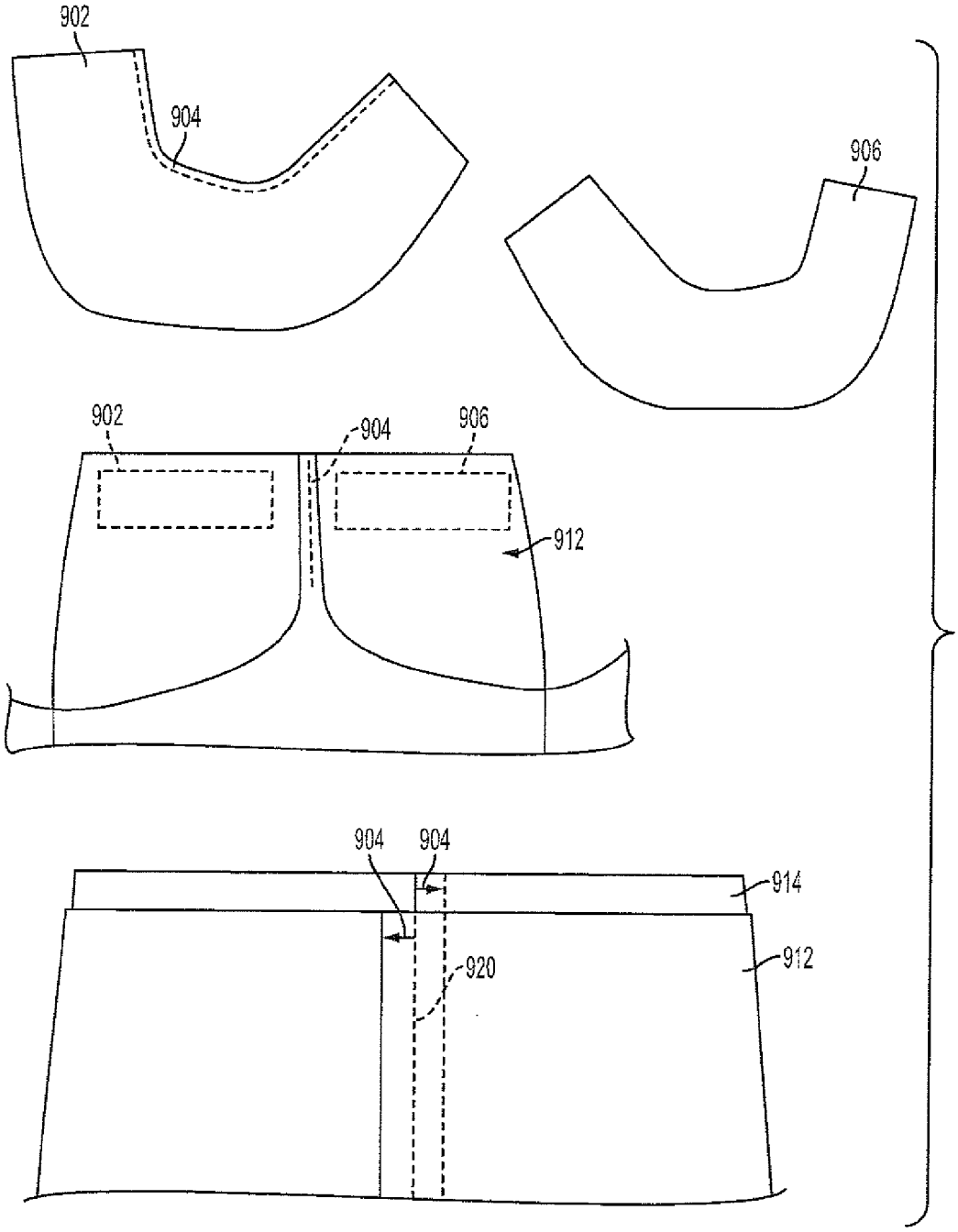
FIG. 9 illustrates one embodiment of a process for attaching the ballistic inserts together for the protective harness of the present disclosure.

FIG. 9 illustrates one embodiment of a process for coupling the individual ballistic members together to form the ballistic insert 600 shown in FIG. 6. Referring to FIG. 9, two different ballistic patterns 902, 906 can be utilized in conjunction with the aspects of the disclosed embodiments. A first type of ballistic pattern 902 includes a seam allowance 904, while a second type of ballistic pattern 906 does not have a seam allowance. The first type of ballistic pattern 902 is coupled to the second ballistic pattern 906 by overlapping the seam allowance 904 of the first ballistic pattern over the second ballistic pattern 906. The aspects of the disclosed embodiments do not provide the typically butted seams that would allow for gaps or the entry of debris into the seam or joining area. Rather, areas of the material that would form the seam are overlapped on each side so there is effectively no gap or other break in coverage of the material at any joining areas. The overlapping nature of these joining areas provides that debris cannot penetrate or get through these joining areas or seams.

Figure 9A:
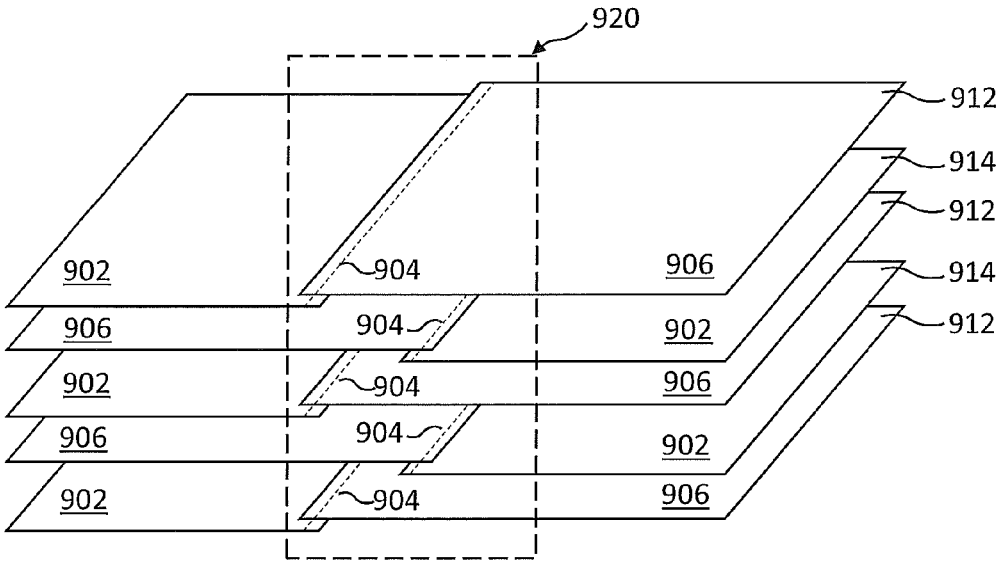
FIG. 9A shows in schematic an overlapped or staggered, flat seam area in accordance with one embodiment of the present disclosure.

In one embodiment, the first ballistic pattern 902 and the second ballistic pattern 906 are sewn together on top of the seam allowance 904 to form a ballistic piece or layer 912. The same is done for each layer. As shown in FIG. 9, two ballistic pieces or layers 912, 914 are illustrated. Although only two layers are illustrated in FIG. 9, in alternate embodiments, any suitable number of layers can be included. As shown in FIG. 9A, each pattern 902, 906 is aligned and sewn together, in schematic, one upon another, to form ballistic layers with an overlapped or staggered, flat seam area 920. Referring again to FIG. 9, after all of the patterns 902, 906 of each layer are sewn together to form the ballistic layers 912, 914, the layers 912, 914 are aligned face-to-face so that the seam allowances 904 on each layer 912, 914, alternate sides. This technique forms a substantially flat seam area 920 without bulk in the crotch area of the wearer. This advantageously reduces vulnerability that may result from aligned seams; it also provides more comfort as well as free range of motion. The aspects of the disclosed embodiments do not restrict the range of motion of the wearer. The unique shape of the protective harness 100, the techniques by which the panel members and ballistic pieces are sewn together, as well as the manner in which the protective harness 100 fits the wearer's body, provides a free and unrestricted range of motion.

The aspects of the disclosed embodiments are directed to wearable body armor for protecting the lower torso. The protective harness is in the form of an outer garment that is configured to be worn over a garment, such as combat uniform. The protective harness is configured to be put on and taken off easily and quickly, and is adjustable in size.

The protective harness is configured to accommodate a ballistics insert that is designed to provide protection to the lower torso. The protective harness provides particular protection of the areas of the urogenital, perineum and femoral artery regions of the lower torso. The protective harness wraps from the front of the person around to the back, while leaving open access to the pockets of the under garment. The open, yet protective design, reduces the heat burden on the user.

The single piece ballistics insert covers the shape of the protective harness, providing increased protection or reduced vulnerability from blast events, and minimizes weight due to less material overlap. The unique design and construction of the protective harness provides improved protection due to its area of coverage. Despite the improved and increased areas of coverage, the protective harness of the disclosed embodiments provides a generally full range of motion. The unique design of the protective harness allows for full access to pockets of a garment worn underneath the protective harness. The attachment or closure system in conjunction with the physical shape of the protective harness does not overly restrict the user's mobility, offers adjustability and remains close to the body when in use to enhance protection.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A blast protection harness for use over pants or shorts, comprising:

a woven front shell portion having a first waist band portion and the front shell portion consisting of a flexible material which is configured to conform to the body of the wearer;

a woven rear shell portion having a second waist band portion and the rear shell portion consisting of a flexible material which is configured to conform to the body of the wearer;

the front shell portion and rear shell portion being joined together at a central location and each having a right leg member and a left leg member and a first coupling member coupling the right leg member of the front shell portion and the rear shell portion together, and a second coupling member coupling the left lea member of the front shell portion and the rear shell portion together;

each of the front and rear shell portions comprising an inner shell member and an outer shell member;

a cavity defined between the inner shell member and the outer shell member of the front shell portion and between the inner shell member and the outer shell member of the rear shell portion wherein the cavity extends contiguously from the front shell portion through the central location and the rear shell portion;

a single contiguous ballistic insert configured to be retained within the cavity, the ballistic insert comprising layers of flexible ballistic material wherein each of the layers are fastened together in an overlapping manner resulting in a staggered, flat seam providing enhanced blast debris protection;

wherein the cavity and, in turn, the ballistic insert are both dimensioned and configured to entirely cover the perineum of the wearer;

wherein the first waist band portion and the second waist band portion are connectable together and the first and second coupling members are connectable together to form a harness that fits and conforms to the shape of the wearer and secures around the waist of a wearer as a stand-alone outer garment worn over pants or shorts; and wherein the waist band portion and the front and rear shell portions define at least one opening that is configured to enable access to at least one pocket of the pants or shorts worn underneath the blast protection harness.

2. The blast protection harness of claim 1, wherein the front shell portion and the rear shell portion consist of a nylon textile.

3. The blast protection harness of claim 1, wherein the first waist band portion and the second waist band portion each are coupled together via a hook and loop arrangement whereby the coupled first and second waist band portions fully support the blast protection harness on the wearer.

4. The blast protection harness of claim 1, wherein each of the first and second coupling members comprise at least one buckle member and one elastic member.

5. The blast protection harness of claim 1, wherein the front shell portion and the rear shell portion each include a joining area defining a center seam and wherein an extension of the harness extends along an inside of each leg of the wearer 8 inches from the center seam so as to be configured to cover a femoral artery region of a leg of the wearer when the front shell portion and rear shell portion are joined together.

6. The blast protection harness of claim 1, comprising a fastener member on an interior portion of the inside shell member configured to mate with a complementary fastener member on the ballistic insert.

7. The blast protection harness of claim 1, wherein the front and rear shell portions are configured to provide contiguous blast ballistic protection to urogenital, perineum and femoral artery areas of a wearer's lower torso.

8. The blast protection harness of claim 1, wherein the ballistic insert is a single piece flexible member and encompasses an entirety of the shell cavity.

* * * * *